US010851686B2

(12) United States Patent
Newman et al.

(10) Patent No.: US 10,851,686 B2
(45) Date of Patent: Dec. 1, 2020

(54) SYSTEM AND METHOD FOR THE DELIVERY AND RECOVERY OF COOLING FLUID AND LUBRICATING OIL FOR USE WITH INTERNAL COMBUSTION ENGINES

(71) Applicant: Sixteen Power, LLC, Troy, MI (US)

(72) Inventors: Caleb Newman, Troy, MI (US); Thomas Robinson, Troy, MI (US)

(73) Assignee: Sixteen Power, LLC, Troy, MI (US)

( * ) Notice: Subject to any disclaimer, the term of this patent is extended or adjusted under 35 U.S.C. 154(b) by 445 days.

(21) Appl. No.: 15/179,560

(22) Filed: Jun. 10, 2016

(65) Prior Publication Data

US 2016/0363095 A1 Dec. 15, 2016

Related U.S. Application Data

(60) Provisional application No. 62/173,516, filed on Jun. 10, 2015.

(51) Int. Cl.

| | |
|---|---|
| ***F02F 1/42*** | (2006.01) |
| ***F01M 1/12*** | (2006.01) |
| ***F02F 7/00*** | (2006.01) |
| ***F01M 11/02*** | (2006.01) |
| ***F02F 1/14*** | (2006.01) |
| *F01P 3/02* | (2006.01) |

(52) U.S. Cl.

CPC ..... *F01M 1/12* (2013.01); *F01M 11/02* (2013.01); *F02F 1/14* (2013.01); *F02F 7/0007* (2013.01); *F02F 7/0012* (2013.01); *F01M 2011/023* (2013.01); *F01M 2011/026* (2013.01); *F01P 2003/021* (2013.01); *F01P 2003/028* (2013.01)

(58) Field of Classification Search

CPC .... F01M 1/12; F01M 11/02; F01M 2011/023; F01M 2011/026; F02F 1/14; F02F 7/0007; F02F 7/0012; F01P 2003/021; F01P 2003/028

USPC ..... 123/193.5

See application file for complete search history.

(56) References Cited

U.S. PATENT DOCUMENTS 3,824,973 A * 7/1974 Harhaus ..... F01M 9/10 123/90.34
4,621,597 A * 11/1986 Kawada ..... F01L 1/04 123/193.5
4,630,580 A * 12/1986 Sawaki ..... F01M 11/02 123/196 R (Continued)

OTHER PUBLICATIONS

General Motors (Cadillac Motor Car Division), Sixteen Cylinder Engine, Revision 12-15-37, Cover p. 204, and pp. 215-216, 65-66 (note that the page numbers correspond to those of the NPL document, not the pdf) (Year: 1937).*

*Primary Examiner* — Hung Q Nguyen
*Assistant Examiner* — Anthony Donald Taylor, Jr.
(74) *Attorney, Agent, or Firm* — Standley Law Group LLP; Adam J. Smith; Jeffrey S. Standley

(57) ABSTRACT

The present invention is an internal combustion engine composed of a plurality of cylinders arranged into banks. Located near the mid-point of each bank of cylinders is a section formed with passages that are configured to provide distribution and recovery of cooling and lubrication fluids. This section is located such that the path of these fluids begins and ends at a mid-point so as to provide a shortened path across each half of the bank of cylinders within which the section is located.

9 Claims, 12 Drawing Sheets

(56) References Cited

U.S. PATENT DOCUMENTS 4,709,667 A * 12/1987 Ichihara ..... F01L 1/053 123/90.27
4,729,349 A * 3/1988 Sonoda ..... F01L 1/053 123/196 R
4,928,641 A * 5/1990 Niizato ..... F01L 1/053 123/196 M
5,027,762 A * 7/1991 Tokuyama ..... F01L 1/053 123/196 M
5,069,192 A * 12/1991 Matsumoto ..... F01M 13/02 123/41.86
6,416,372 B1 * 7/2002 Nozue ..... F01M 11/0004 440/88 D
6,418,886 B1 * 7/2002 Haimerl ..... F02B 75/22 123/41.28
6,843,209 B2 * 1/2005 Miyagawa ..... F01P 5/10 123/41.1
7,373,911 B2 * 5/2008 Taguchi ..... F01M 11/02 123/195 C
8,156,905 B2 * 4/2012 Stemmer ..... F01M 1/02 123/195 R
8,171,897 B2 * 5/2012 Sugiura ..... F01P 1/02 123/41.01
9,518,505 B2 * 12/2016 Matthews ..... F02B 37/00
2002/0189558 A1 * 12/2002 Batzill ..... F01P 5/10 123/41.44
2004/0244783 A1 * 12/2004 Ookawa ..... F01M 13/022 123/572
2007/0240692 A1 * 10/2007 Takahashi ..... F01M 11/02 123/572
2008/0236950 A1 * 10/2008 Wieg ..... F01M 1/12 184/6.5
2008/0245613 A1 * 10/2008 Rutschmann ..... F01M 13/02 184/6.5
2014/0157773 A1 * 6/2014 Matthews ..... F02B 37/00 60/605.3
2015/0128886 A1 * 5/2015 Ogino ..... F01M 11/02 123/54.4

* cited by examiner

SYSTEM AND METHOD FOR THE DELIVERY AND RECOVERY OF COOLING FLUID AND LUBRICATING OIL FOR USE WITH INTERNAL COMBUSTION ENGINES

CROSS-REFERENCE TO RELATED APPLICATION

This application claims priority to provisional application 62/173,516 filed on Jun. 10, 2015 and is incorporated by reference in its entirety as if fully recited herein.

TECHNICAL FIELD

Exemplary embodiments of the present invention relate generally to improvements to a lubrication and cooling system for use in multi-cylinder internal combustion engines.

BACKGROUND AND SUMMARY OF THE INVENTION

The design and production of high performance internal combustion engines is an extremely competitive industry. Designers and builders of such engines look for every improvement possible in order to provide an edge over their competitors. Equally concerned are the consumers who purchase these engines. These purchasers are generally looking for a combination of performance and reliability that allows the purchaser to obtain the best possible combination of such qualities according to their needs. Therefore, improvements that may increase output horsepower, improve performance characteristics, improve reliability, or reduce the difficulty of building and maintaining such engines are of great value to designers, builders, and consumers alike.

High performance internal combustion engines generally have more than one combustion chamber (cylinder). In fact, to a practical limit, greater numbers of cylinders improves engine performance by allowing improved cylinder geometry for larger displacement engines and more even delivery of power throughout the rotation of an engine crankshaft. As is well known, all other variables being equal, a larger engine displacement is capable of producing more power than a lesser displacement. Thus, increasing the number of cylinders may allow an engine designer to optimize such characteristics as piston diameter and stroke, while maintaining a larger total displacement. This enables the designer to produce an engine having desired characteristics such as quick response to throttle inputs, improved torque production, or higher RPM capability.

Multi-cylinder engines are generally configured according to several known configurations where the cylinders are arranged in sets commonly referred to as "banks." In a typical embodiment, each bank is comprised of two or more cylinders arranged along a crankshaft. Example configurations may be a single bank consisting of a plurality of cylinders (an "in-line" engine) or cylinders arranged in multiple banks (generally two), each comprising a plurality of cylinders. These banks may be arranged at an angle radially from the crankshaft of the engine. Where the cylinder banks are arranged at an angle of less than 180 degrees, the engine is commonly referred to as a "V" configured engine. Such engines are generally also referred to according the number of cylinders embodied in the engine design. For example an eight cylinder engine may be referred to as a "V8", a ten cylinder engine a "V10", a sixteen cylinder engine a "V16" and so forth. One skilled in the art, after examining the invention disclosed herein will understand that certain embodiments of the invention may be applied to internal combustion engine configurations other than "V" configurations. For example, without limitation, embodiments of the invention may be implemented in single bank engines and also engines in which the banks are arranged in other than the described "V" shape.

Internal combustion engines generally must be provided with some method of lubrication and cooling in order to function reliably for more than a short time. One of the difficulties encountered in the design of reliable, high power output, multi-cylinder engines is the consistent delivery of lubrication and cooling through the various cylinders. Known multi-cylinder engine designs are configured such that lubricating oil and cooling fluid is introduced to the cylinder banks at one end of the bank and circulated from that end to the opposite end of the cylinder bank in various passageways. As the number of cylinders in a bank increases, the requirement of additional passageways causes the pressure and volume of lubricating oil to be reduced for each successive cylinder of the bank. The result is that the cylinders farthest from the source of oil may be subjected to increased wear and lesser reliability. In the case of cooling fluid, the fluid may absorb heat from each cylinder as the fluid moves past the cylinder. With each cylinder, the fluid becomes increasingly hotter and is thus less able to absorb heat. As a result, the last cylinder in the path of cooling fluid may receive less cooling than those cylinders earlier in the path of the cooling fluid.

What is needed is an improved engine design that permits consistent delivery of both lubrication and cooling to multi-cylinder engine designs. In an embodiment of the invention, a multi cylinder engine may be formed such that an additional space is provided at the mid-point of a cylinder bank. In such embodiments, this additional space may be used to introduce lubricating oil at a point mid-way along the cylinder bank. Such an embodiment may reduce the number of cylinders along a lubricating oil path by creating shorter parallel paths, rather than one longer path before the lubricating oil is allowed to drain to a collection point for re-pressurization and re-delivery to the engine.

An embodiment of the invention may deliver cooling fluid at a point mid-way along the cylinder bank. Such a delivery location may allow a flow of the fluid to collect heat from a reduced number of cylinders before being channeled to a heat exchanger which reduces the temperature of the cooling fluid before re-delivery to the engine. In other embodiments of the invention, lubricating oil may be collected in a central valley between banks of cylinders and allowed to drain from the valley through the additional space directly to a collection point. This differs from known designs in which the lubricating oil drains from a plurality of locations which allow the lubricating oil to make contact with moving portions of the engine such as the crankshaft and connecting rods. Such contact causes the lubricating oil to be thrown and agitated by these moving portions. Such throwing and agitations absorbs engine power that could otherwise be delivered by the crankshaft of the engine. Agitation may also introduce air bubbles into the lubricating oil which reduces its lubricating effectiveness. In addition to oil agitation by moving engine parts such as the crankshaft, the return flow of oil may be disrupted by engine movement. In an embodiment of the invention, an oil guide may be positioned at certain points of the engine to contain and direct a flow of oil to a central collection point.

In certain embodiments of the invention, an additional space located at the mid-point of a cylinder bank may allow the use of cylinder heads designed for conventional engines to be used in combination across a bank of cylinders.

Further features and advantages of the devices and systems disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Coolant Flow

Figure 1:
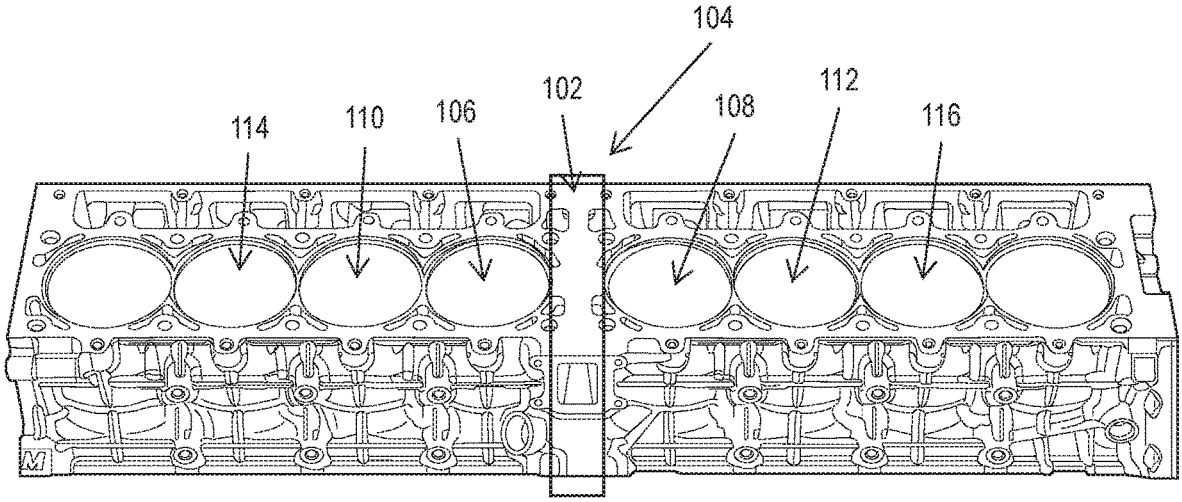
FIG. 1 is a perspective view of a bank of engine cylinders according to an embodiment of the invention.
Figure 2:
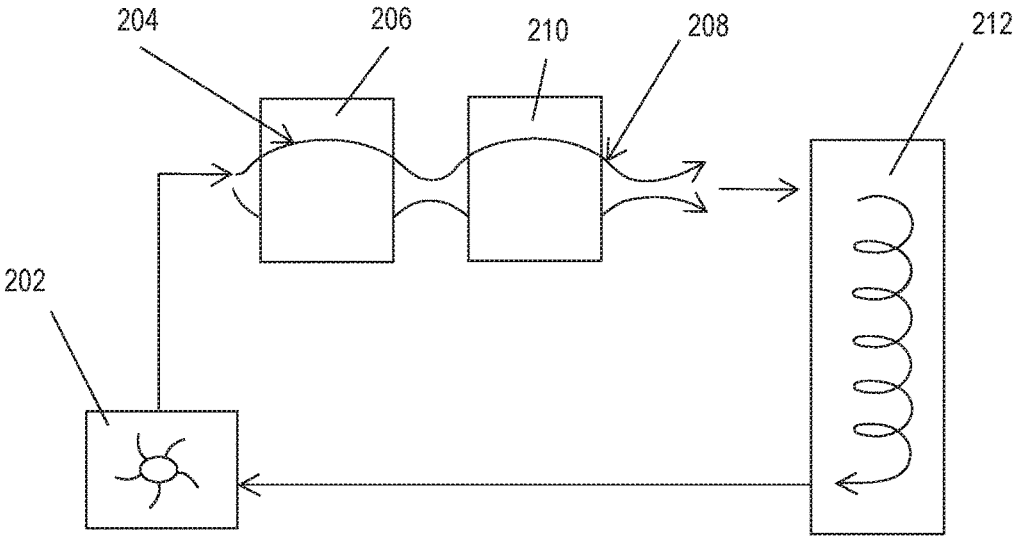
FIG. 2 is a diagram illustrating an exemplary engine cooling system.
Figure 3:
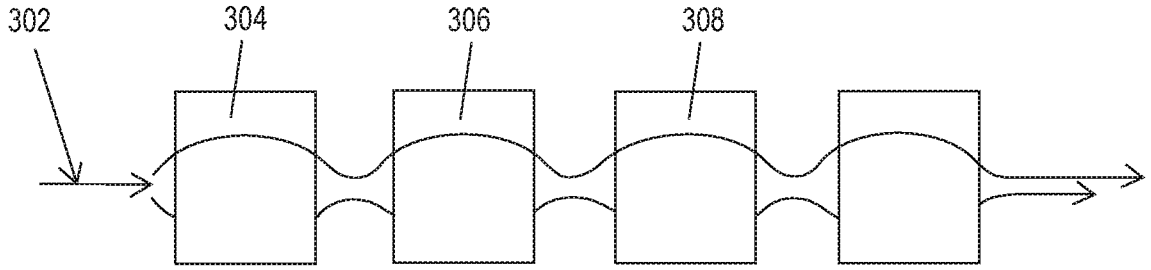
FIG. 3 is a diagram of a known method of cooling engine cylinders.
Figure 4:
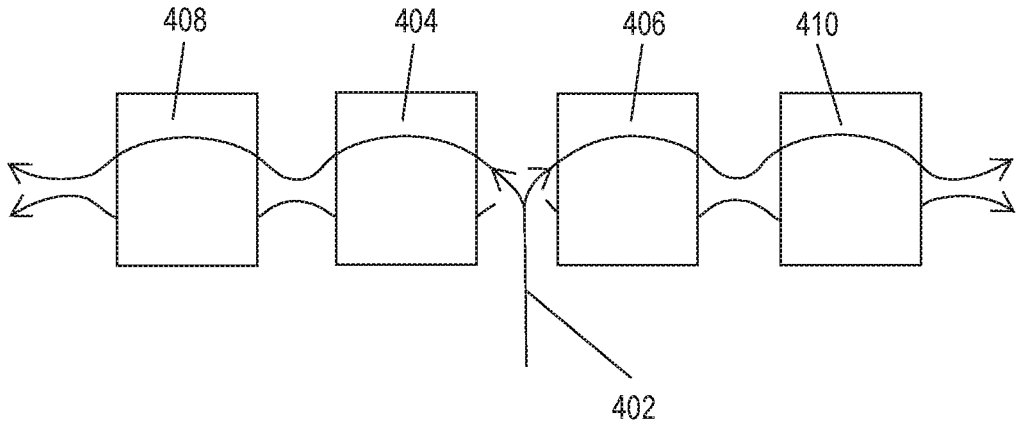
FIG. 4 is a diagram of an embodiment of the invention used to cool engine cylinders.
Figure 5:
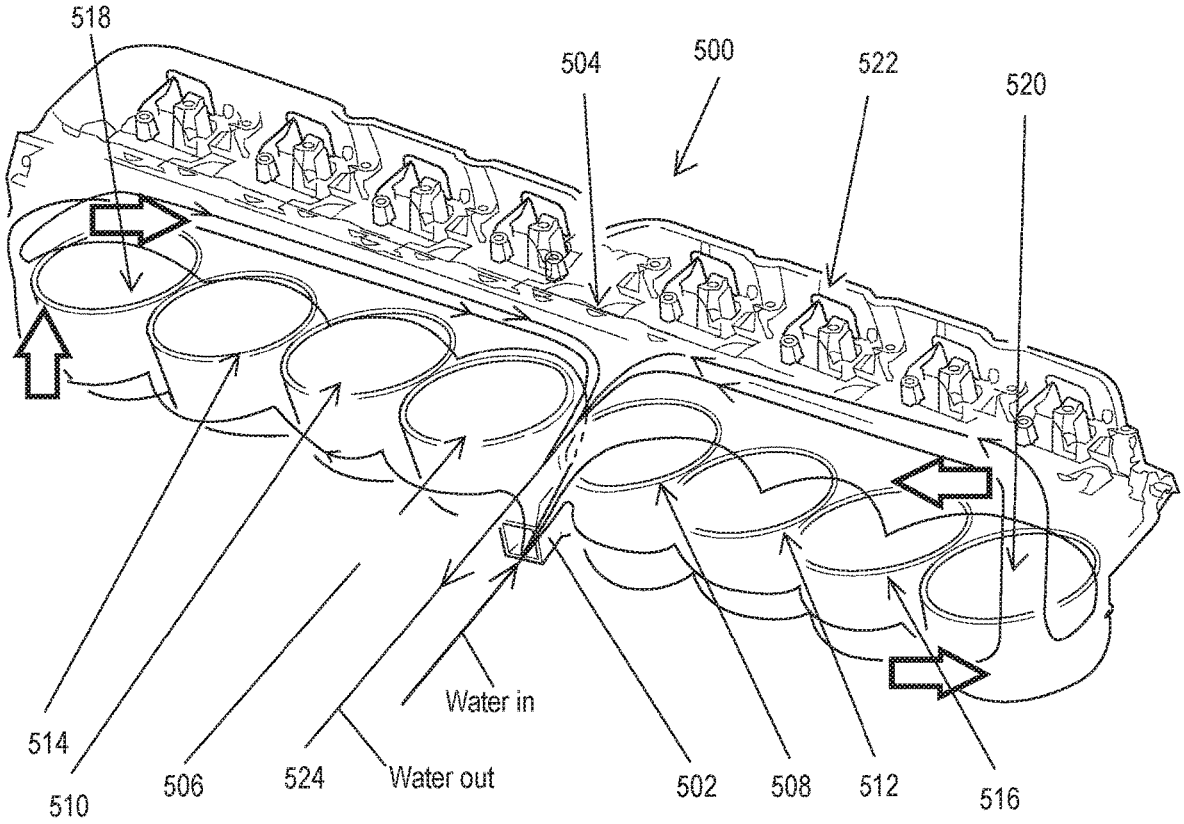
FIG. 5 is a phantom view of coolant flow passages in an engine block and cylinder head according to an embodiment of the invention.

As was noted above, internal combustion engines are generally comprised of a plurality of combustion chambers, commonly referred to as cylinders. In multiple cylinder engines, these cylinders are arranged adjacent to one another in configurations referred to as banks. An illustration of a bank of cylinders is shown in FIG. 1. As is well known in the art, internal combustion engines produce large amounts of heat during operation. In order to avoid damage and improve the efficiency of such engines, a means must be provided to remove heat from the engine. This is particularly critical in the areas adjacent to the cylinders as a result of the internal combustion process that takes place within each cylinder. A common cooling method is the circulation of a cooling fluid around the cylinder. To avoid cooling fluid entering the combustion chamber or contaminating the lubricating oil system of an engine, the cooling fluid is circulated in passageways surrounding each cylinder. A simplified representation of a known cooling system is shown in FIG. 2. Illustrated is a fluid pump 202 which causes the cooling fluid to flow first through passageways 204 around a first cylinder 206, and then through passageways 208 around a second 210 and subsequent cylinder (not illustrated). After passing around all cylinders in a bank, the cooling fluid may travel through a heat exchanger 212 where heat is removed from the cooling solution. The cooling solution may then return to the fluid pump 202 to repeat the above process. As the cooling fluid travels around each cylinder, it removes heat from that cylinder. The process of transferring heat from the cylinder to the cooling fluid raises the temperature of the cooling fluid. As one ordinarily skilled in the art will understand, the cooling fluid will become increasingly hot with each cylinder that the fluid travels around. As one of ordinary skill in the art will also understand, other conditions being equal, the amount of heat transferred from a first substance to a second substance decreases as the difference in temperature of the two substances decreases, thus the ability of a cooling fluid to remove heat is decreased as the temperature of the fluid rises. Referring to the bank of cylinders illustrated in FIG. 3, in a known embodiment, a flow of coolant enters at 302. As the coolant passes the first cylinder 304, the coolant removes a certain amount of heat from that cylinder. This heat causes the coolant temperature to rise. When the coolant passes the second cylinder 306, a certain amount of heat is removed from the second cylinder but, because the coolant was hotter than it was when it first entered the bank of cylinders at 302, the amount of heat removed from the second cylinder may be less than was removed from the first cylinder 304. The heat from the second cylinder 306 causes the cooling fluid temperature to rise above what it was after the first cylinder 304. As the even hotter cooling fluid passes by the third cylinder 308, it may remove less heat than was removed from the first or second cylinders. As the result of the heat removed from the third cylinder 308, the temperature of the cooling fluid rises again. This process is repeated for each successive cylinder, with less heat being removed from cylinders as the temperature of the cooling fluid rises. Therefore, more heat will remain in each cylinder as those cylinders are farther from the point that cooling fluid is introduced. The result is that the temperatures of these cylinders may increase as they become farther from the point that cooling fluid is introduced. It is well known that increased temperatures cause greater levels of undesirable stress and wear of the cylinder components. As was noted above, increased numbers of cylinders may provide an increased level of engine performance. However, with an increase in the number of cylinders in an engine configuration, cooling fluid may be required to pass across a greater number of cylinders before being provided to a heat exchanger for removal of excess heat. In known designs, cylinders that come later in the path of cooling fluid may be subject to undesirably high temperatures, reducing their performance. In order to reduce the difference in temperature across a bank of cylinders, an embodiment of the invention may introduce coolant at or near the mid-point of such a bank of cylinders. As illustrated in FIG. 1, a passageway 102 may be formed in an embodiment of the invention that is at a mid-point 104 of a cylinder bank. As is illustrated in FIG. 4, in such an embodiment, coolant may enter from a mid-point 402 and diverge to flow across a first left cylinder 404 and a first right cylinder 406. As the coolant flows across these cylinders, heat is removed from the first left 404 and first right 406 cylinders. As with the coolant described in regard to FIG. 3, the coolant may increase in temperature after passing over these first cylinders. After the coolant moves from the first left and first right cylinders, it may move across second left 408 and second right 410 cylinders and remove heat from these cylinders also. As is illustrated, for the same number of cylinders as were illustrated in the known embodiment of FIG. 3, the embodiment of the invention illustrated passes cooling fluid across a first and second cylinder as opposed to first, second, third, and fourth cylinders of the known embodiment. Thus, the temperature of the coolant at the last cylinder in an inventive embodiment may be lower for a given number of cylinders than a known embodiment. As was noted earlier, heat transfer is improved when the difference in temperature between the source of the heat and the substance to which heat will be transferred is greater. Thus, in the embodiment illustrated in FIG. 4, the temperature between the outer cylinders (408 and 410) and the coolant flowing past them is greater than the difference that may result between cylinder 308 and the coolant of FIG. 3. The result is an improved removal of heat and thus lower cylinder temperatures in the inventive embodiment when compared to known embodiments. In an embodiment of the invention, this centralized delivery of coolant is enabled by the use of an inventive centrally located passageway 102 as illustrated in FIG. 1. FIG. 5 shows a phantom view of a partial engine block and cylinder head 500 configured to use an embodiment of the invention. As shown, a coolant inlet 502 enables coolant to enter at a midpoint 504 and flow around cylinders 506 and 508. The coolant then flows around cylinders 510 and 512, followed by 514, 516, 518 and 520. After flowing around the cylinders, the coolant may be circulated through a cylinder head (illustrated as a phantom part) 522 and returned to a common outlet 524 from which the coolant may be passed through a heat exchanger prior to recirculation. As one ordinarily skilled in the art will realize after reading this disclosure, multi-cylinder engines, particularly high output engines with more than four cylinders per bank will realize more uniform cooling across those cylinders in a bank using an embodiment of the invention than would be achieved using known methods.

Figure 14:
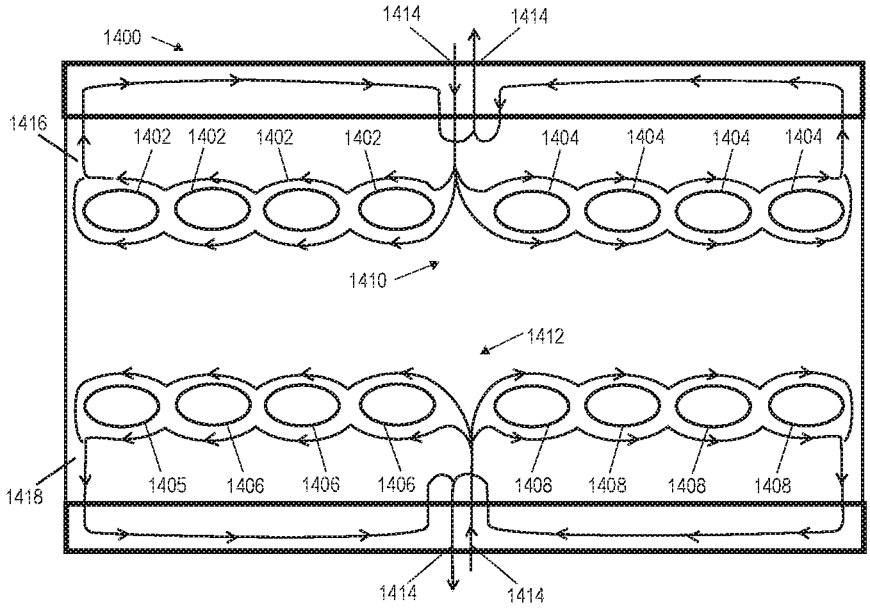
FIG. 14 is a simplified diagram of an embodiment of the invention for cooling a sixteen-cylinder engine.

Exemplary cooling of a sixteen-cylinder engine block 1400 is illustrated at FIG. 14. Flow of a coolant 1414 about cylinders 1402, 1404, 1406, and 1408 of the engine block 1400 is illustrated generally by arrows.

More specifically, a first flow of coolant 1414 may enter a first cylinder bank 1416 at a first supply channel. The first supply channel may be located between the middlemost cylinders 1402 and 1404 of the first bank of cylinders 1416. A first portion of the first flow of coolant 1414 may travel about each of four cylinders 1402 in a first group of cylinders. The first portion of the first flow of the coolant 1414 may return to the first supply channel to exit the engine block 1400. A second portion of the of the first flow of coolant 1414 may travel about each of four cylinders 1404 in a second group of cylinders. The second supply channel may be located between the middlemost cylinders 1406 and 1408 of the second bank of cylinders 1418. The second portion of the first flow of the coolant 1414 may return to the first supply channel to exit the engine block 1400.

A second flow of coolant 1414 may enter a second cylinder bank 1418 at a second supply channel. A first portion of the second flow of coolant 1414 may travel about each of four cylinders 1406 in a third group of cylinders. The first portion of the second flow of the coolant 1414 may return to the second supply channel to exit the engine block 1400. A second portion of the of the second flow of coolant 1414 may travel about each of four cylinders 1408 in a fourth group of cylinders. The second portion of the second flow of the coolant 1414 may return to the second supply channel to exit the engine block 1400.

Oil Flow

When describing the lubrication systems of internal combustion engines herein, references to lower engine lubrication are intended to refer to lubrication of the crankshaft and connecting rod portions of the engine. References to upper engine lubrication refer to lubrication of those components located in the upper portions of conventionally mounted engines. Engine components which are located in the upper portions of an engine may comprise camshafts, valve lifters, pushrods, and rocker arms (if an engine is configured to utilize these components). As one ordinarily skilled in the art will understand, in known embodiments, the upper portion of a cylinder bank may receive its lubricating oil from a single inlet where the inlet is located at an end of the bank of cylinders. Such a configuration may result in a loss of pressure and oil flow as the oil moves from the inlet across the bank of cylinders. This loss of pressure and oil flow may result in suboptimal lubrication of upper engine components. Such a condition may result in increased engine wear, increased operating temperature and premature engine failure.

In an embodiment of the invention, a lubricating oil inlet may be positioned centrally in a cylinder bank. Referring to FIG. 1, the passageway 102 formed between adjacent cylinders may comprise at least one oil inlet. From the passageway oil inlet, lubricating oil may be directed towards valve lifters, camshaft bearings, rocker arms and other components associated with individual cylinders. As with the cooling fluid distribution previously described, lubrication oil distributed centrally may diverge to be distributed to components associated with a first left cylinder 106 and a first right cylinder 108. After the first right and left cylinders, lubricating oil may be distributed to second left 110 and second right 112 cylinders, third left 114 and third right 116 cylinders, and so forth until all cylinders in a bank have received lubrication oil. In such an embodiment, lubricating oil will be received at greater pressure and flow levels across a multi-cylinder bank than would be present in a similar bank utilizing known lubrication oil distribution methods which start the lubricating oil distribution at one end of a bank of cylinders. As is well known in the art, sufficient pressure and oil flow are critical to achieving reliability and long life in high output power engine designs. Thus, one ordinarily skilled in the art will realize after reading this disclosure that the delivery of high and consistent lubricating oil pressure and flow made possible by the present invention may result in a more reliable and more durable engine.

Oil Return

Figure 6:
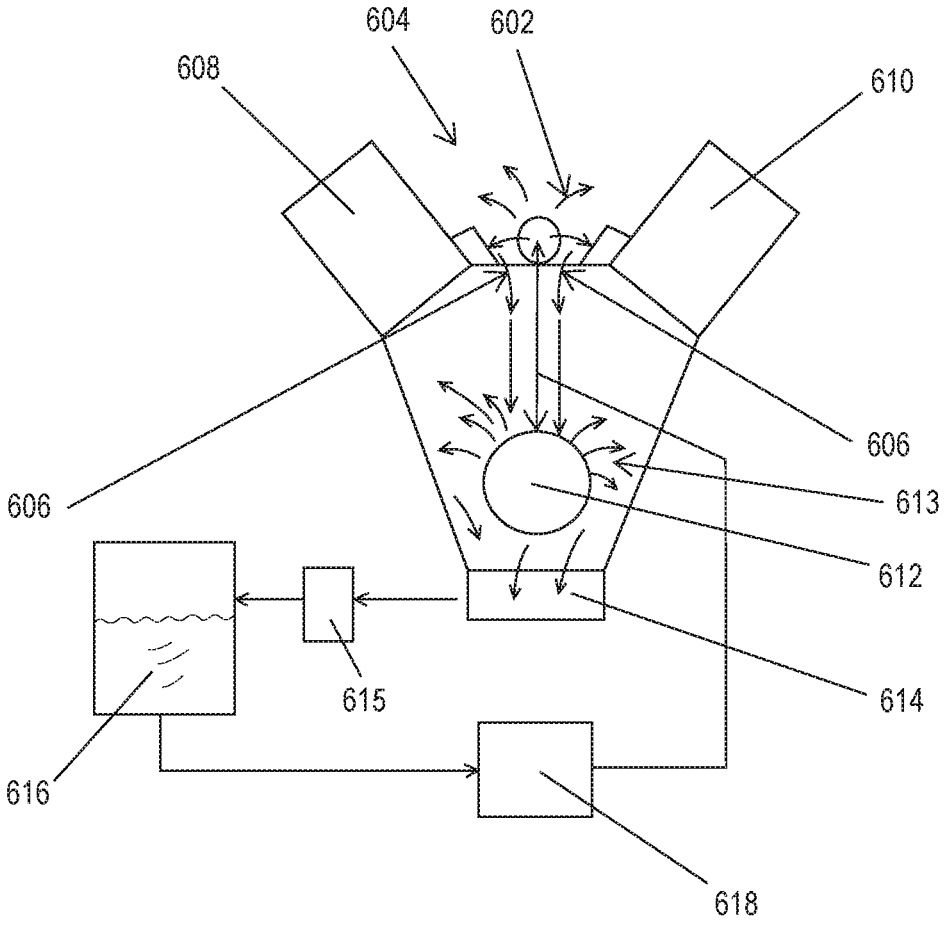
FIG. 6 is a diagram of a known lubricating oil delivery system.

Referring to FIG. 6, known lubrication oil systems used in "V" type engine configurations are arranged to allow unpressurized lubricating oil 602 to drain from the camshaft lifter bay area 604 of an engine at various points 606 along the lifter bay as it extends between a first cylinder bank 608 and a second cylinder bank 610. As is illustrated, unpressurized oil returning to the crankcase sump may make contact with the rotating crankshaft 612. Such contact, particularly with those eccentric portions of the crankshaft which are connected to the piston connecting rods and counterweights associated with these eccentric portions, may result in lubricating oil being splashed 613 about the open area of the crankcase. The result is a loss of power and potentially an undesirable aeration of the lubricating oil. The oil may eventually make its way to the engine sump 614 where it may be evacuated by a first pump 615 for storage in an oil storage tank 616 prior to being pressurized by a second pump 618 and returned to the engine. One of ordinary skill in the art will understand that the lubricating systems illustrated herein are dry sump systems. Embodiments of the invention are equally applicable to a wet sump system wherein unpressured oil is returned to an oil pan portion of the engine before being pressurized by an oil pump and provided to various lubrication points throughout the engine.

Figure 7A:
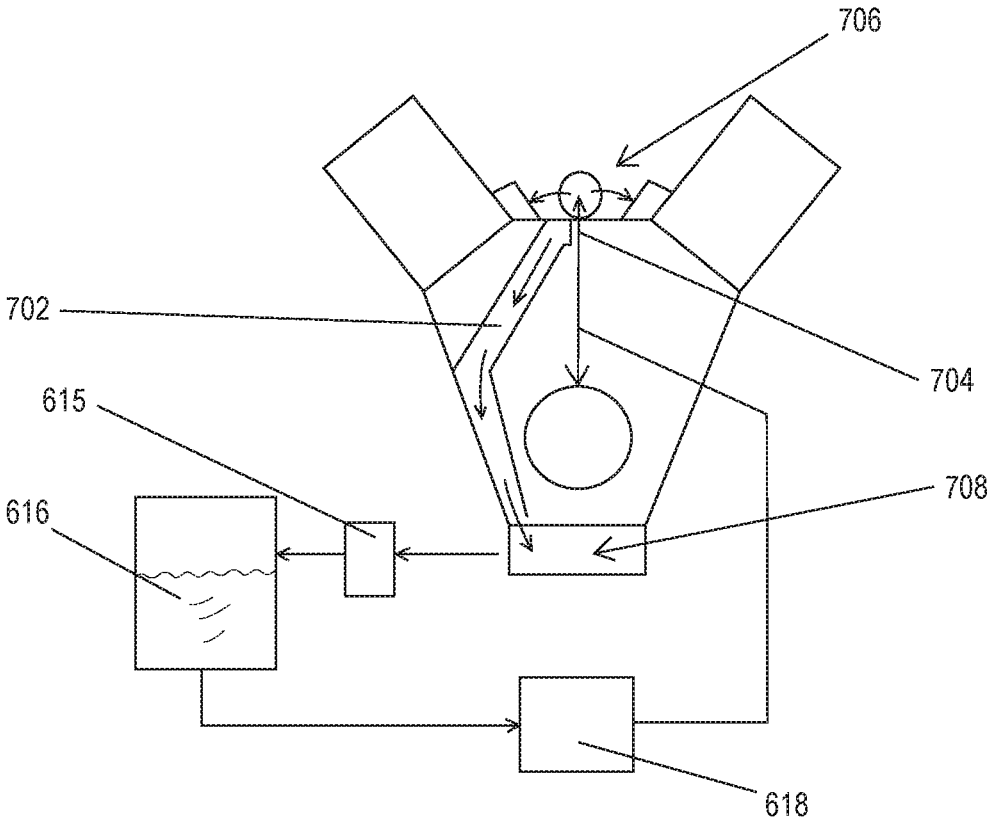
FIGS. 7*a* and 7*b* are diagrams of a lubricating oil delivery system viewed from an end and side of an engine according to an embodiment of the invention.
Figure 7B:
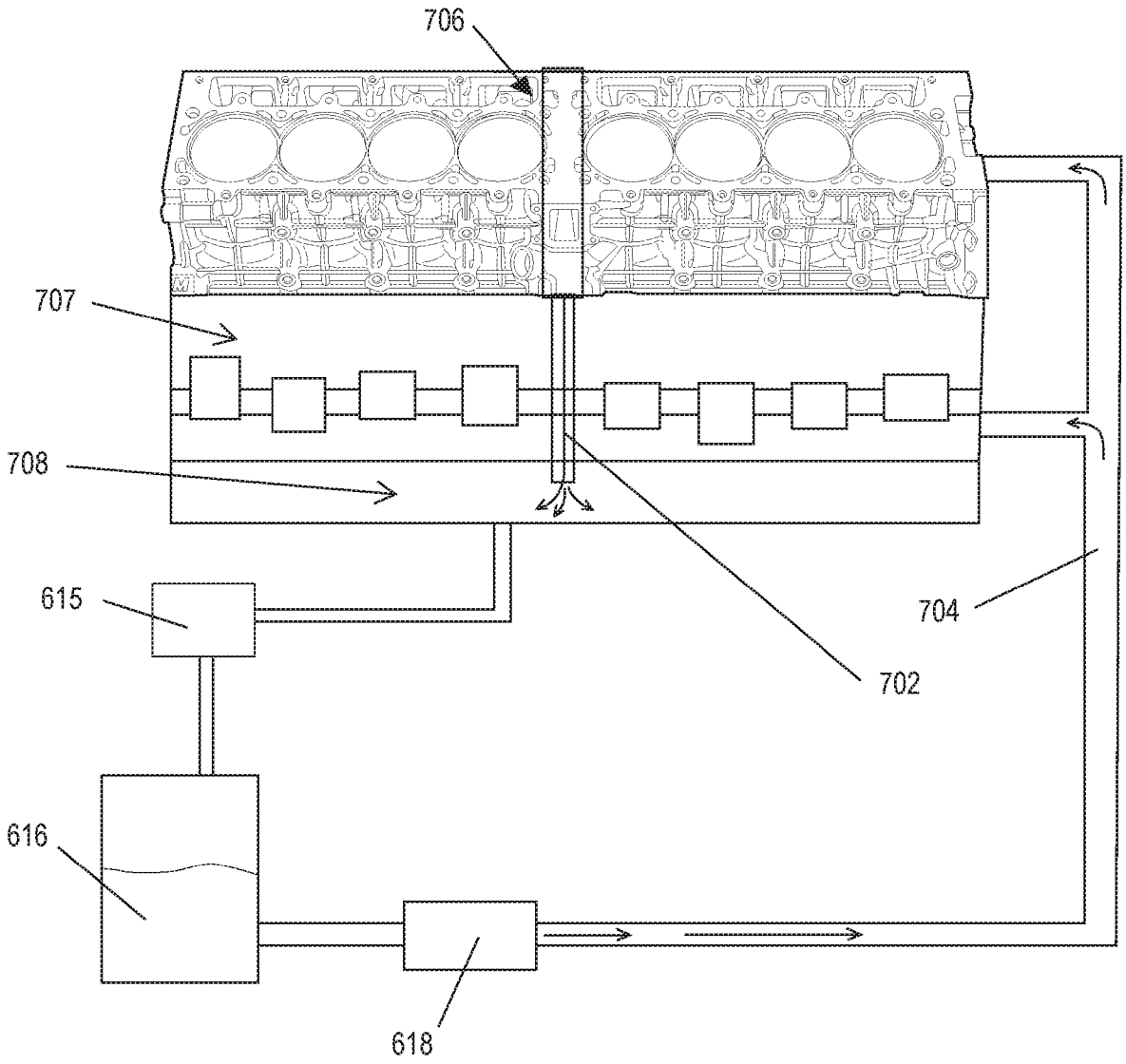
Figure 8:
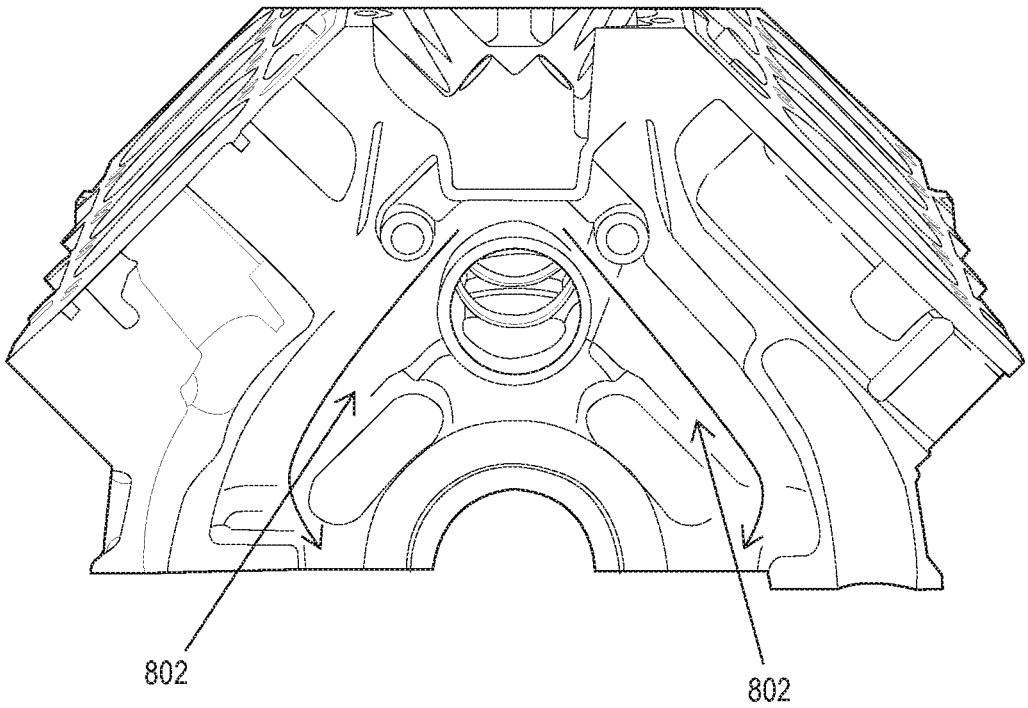
FIG. 8 is a cross section view of a lubricating oil return passage according to an embodiment of the invention.

Referring to FIGS. 7*a* and 7*b*, an embodiment of the invention may be configured with centrally located oil returns 702. An embodiment of such a central oil return is also illustrated in FIG. 8 at 802. Referring again to FIGS. 7*a* and 7*b*, as is illustrated, pressurized lubricating oil 704 is provided to the upper engine portion 706 and the crankshaft portion 707. A single feed is illustrated in FIG. 7*b* but one ordinarily skilled in the art will understand that multiple feeds may be used depending upon the engine configuration to which an embodiment of the invention is applied. After use by the upper engine portion 706, the unpressurized lubricating oil is returned to the engine sump 708 through the central oil returns 702. As is illustrated, these returns channel the oil directly to the engine sump area 708, avoiding contact with the rotating crankshaft. By avoiding the crankshaft, the oil is not thrown around the crankcase, reducing power loss as well as the possibility of oil aeration. The oil is then collected from the sump by a first pump 615 (often referred to as a scavenge pump) for storage in an oil storage tank 616 prior to being pressurized by a second pump 618 and returned to the engine. Referring again to FIG. 1, in embodiments of the invention with a central passageway 102 at the midpoint of a cylinder bank 104, the central oil returns may be located within an area of the central passageway.

Figure 9:
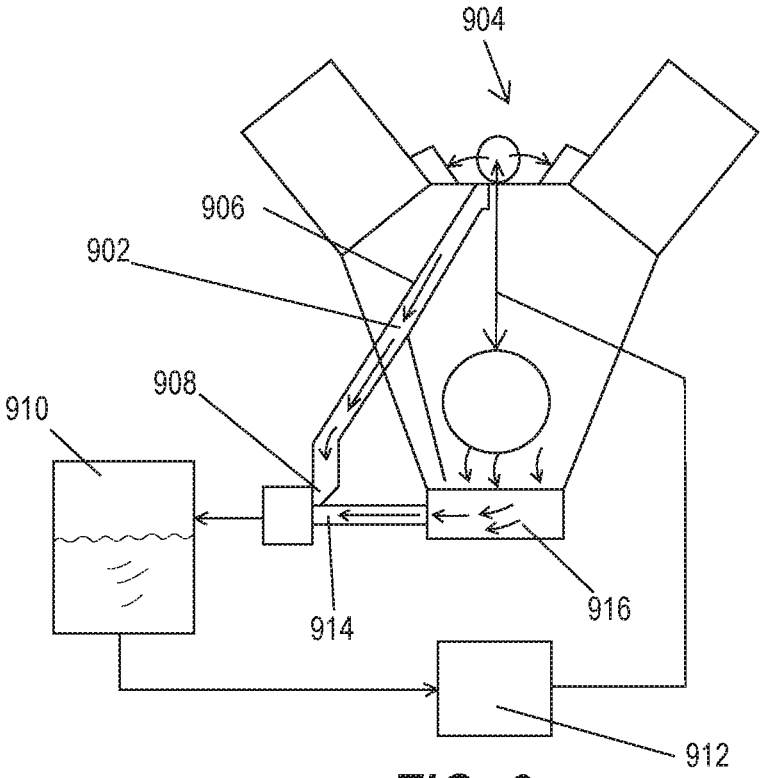
FIG. 9 is a diagram of a lubricating oil delivery system according to an embodiment of the invention.

In certain embodiments of the invention, the central oil returns described above may be directed to a dedicated input of a scavenge pump for delivery to an oil storage tank. Referring to FIG. 9, which illustrates an example of such an embodiment, unpressurized lubricating oil 902 may flow from the upper engine portions 904 through one or more central oil returns 906. In such an embodiment, the central oil return(s) may be directed to a dedicated scavenge pump input 908 for storage in an oil storage tank 910 prior to being pressurized by a second pump 912 and returned to the engine. In such an embodiment, additional scavenge pump inputs 914 may be used to collect unpressurized oil from an engine sump 916. In embodiments of the invention implemented in a wet sump configuration, a first pump (scavenge pump) and an oil storage tank is not used. In such a configuration, the central oil returns 906 may return the collected unpressurized oil to an oil pan for collection and pressurization before being delivered to lubrication points throughout the engine.

Oil Return Guide

Many high performance engines are used in applications subject to sudden acceleration along various axes. Without limitation, an example application that introduces such sudden accelerations may be offshore powerboat racing. In such an application, the powerboat (along with an engine mounted in the powerboat) is subject to repeated buffeting as the result of a water surface that is less than smooth. In such applications, unpressurized lubricating oil is ideally removed from the engine after use and stored remotely from the engine crankcase until it is pressurized and re-introduced to the engine. Such remote storage, commonly referred to as a "dry sump", provides a lubrication system that is less susceptible to buffeting and g-forces which can cause irregular oil delivery to critical engine components.

Figure 10:
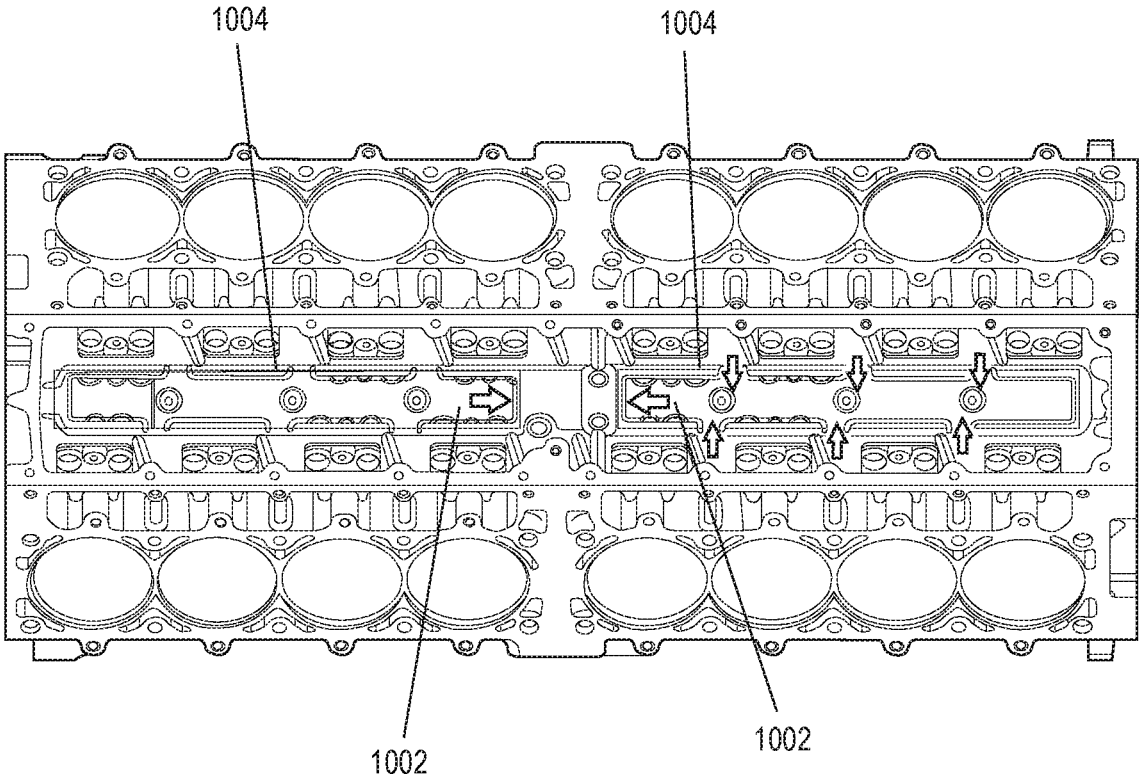
FIG. 10 is a perspective view of an engine block illustrating an embodiment of the invention.
Figure 11:
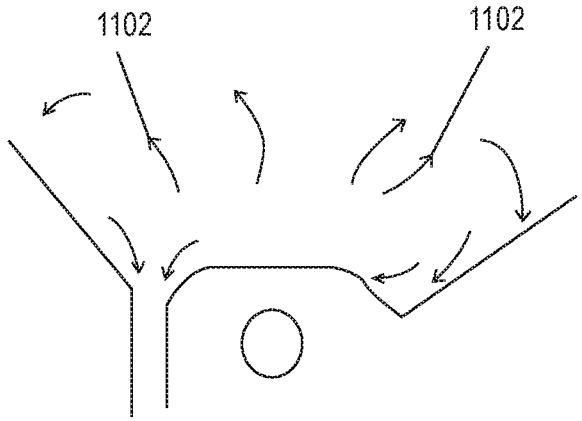
FIG. 11 is a diagram of an embodiment of the present invention.
Figure 12:
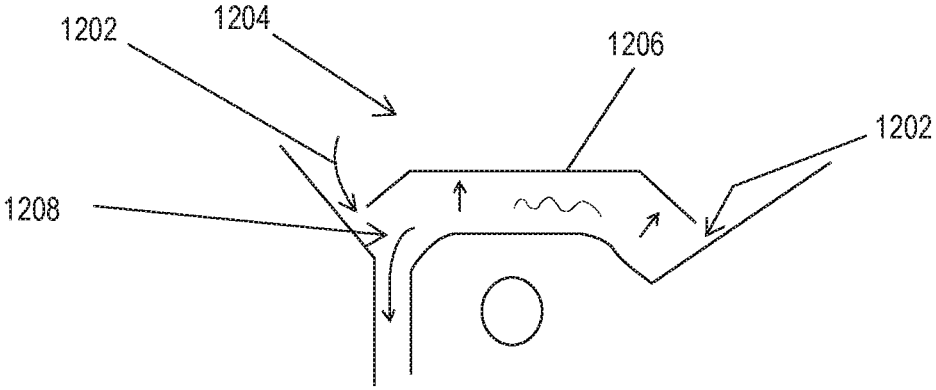
FIG. 12 is a diagram of an embodiment of the present invention equipped with an oil return guide.

In an embodiment of the present invention, a further improvement may be realized by the introduction of an oil return guide system. As is illustrated in FIG. 10, unpressurized upper engine 1002 oil may flow to a central drain as previously disclosed herein. Referring to FIG. 11, in an embodiment of the invention without an oil return guide system, the previously described sudden accelerations may cause the returning oil to splash away from its return path 1102, reducing the efficiency of the oil return process. In an embodiment of the invention as is illustrated in FIG. 12, unpressurized oil 1202 may enter the valve lifter channel 1204. As is shown, an oil return guide 1206 located above the floor of the valve lifter channel 1204 may contain the unpressurized oil between the cover and the floor of the valve lifter channel. This containment may serve to reduce the amount of splashing oil that results from sudden acceleration and facilitate a more efficient flow of oil 1208 to the engine sump or scavenge pump. Referring again to FIG. 10, such an oil return guide 1206 may extend along the floor of the valve lifter channel as illustrated at 1004.

Cylinder Head Configuration

Figure 13:
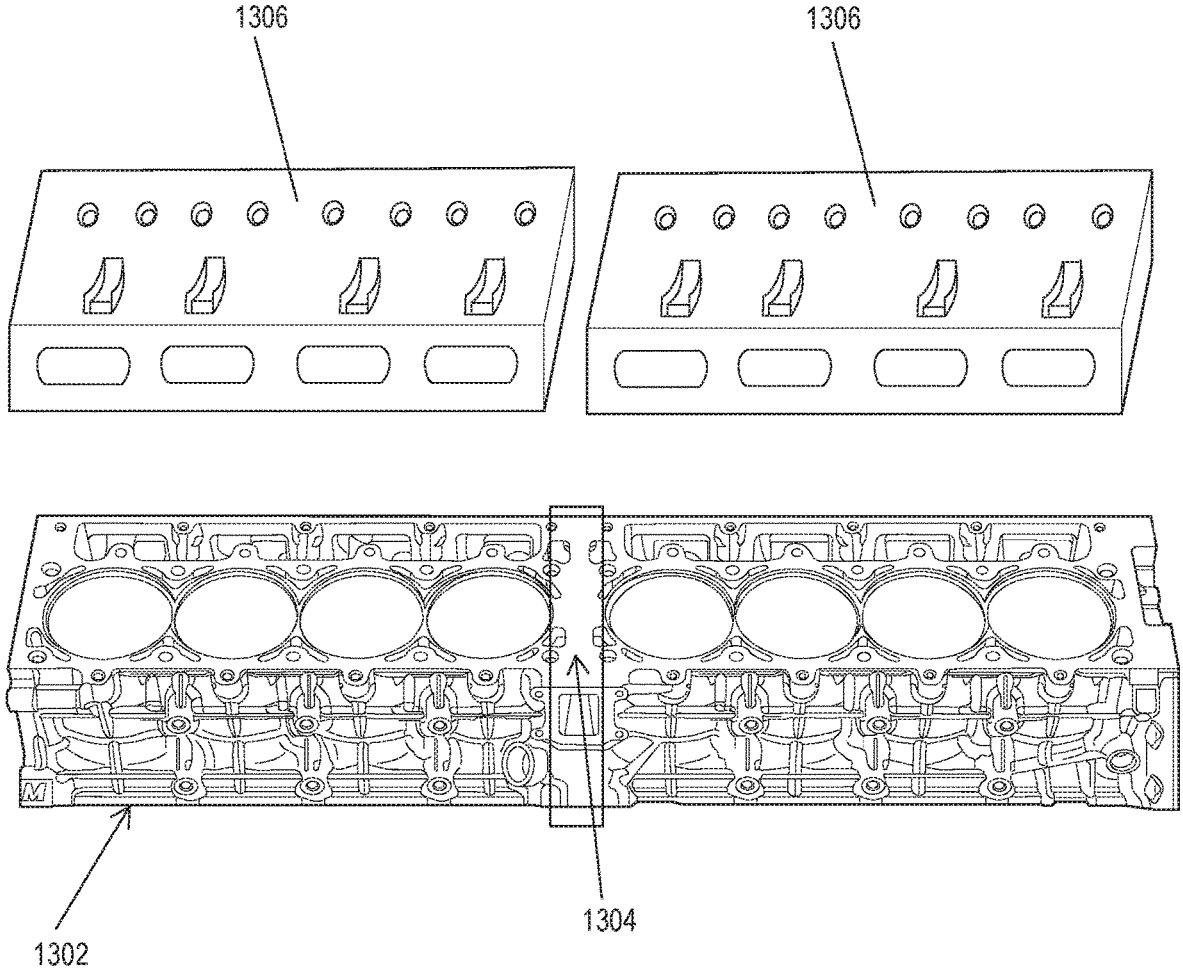
FIG. 13 is a perspective view of a bank of engine cylinders illustrating cylinder heads according to an embodiment of the invention.

As was described above, in certain embodiments of the invention, passageways may be formed at the midpoint of a cylinder bank. Such a passageway may have the additional benefit of creating an additional space between adjacent cylinders. An example of such an embodiment is illustrated in FIG. 13. As may be noted in the illustrated bank of cylinders 1302, a passageway 1304 is positioned at a point that is at an approximate midpoint of the bank. A benefit of such a configuration may be the capability to employ cylinder heads 1306 designed for engines comprising a lesser number of cylinders. In certain embodiments, such engines may be commercially available and produced in quantities such that components for those engines, such as cylinder heads, may be more readily available and thus less costly then cylinder heads that are manufactured for less common engine configurations. As illustrated in FIG. 13, the bank of cylinders is formed from eight individual cylinders. As shown, two cylinder heads 1306, each designed to accommodate four cylinders may be employed in such an embodiment. Cylinder heads designed for three and four cylinders per head are well known in the field of internal combustion engines. Therefore, such an embodiment may have the advantage of being able to be fitted with cylinder heads readily available from third parties, greatly reducing the development and tooling expense required to produce a complete engine.

After reading this description, one ordinarily skilled in the art will realize that the described embodiments may be applied to any number of cylinders per bank. Thus, the invention should not be construed as being limited to number of cylinders illustrated in the referenced figures or expressly described herein. Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. An internal combustion engine comprising:

a sixteen-cylinder, V-shaped engine block, wherein the cylinders are arranged in a bilateral fashion whereby eight of said sixteen cylinders are located along a first side of said engine block and form a first bank of cylinders comprising a first grouping of four cylinders and a second grouping of four cylinders, and whereby the remaining eight of said sixteen cylinders are located along a second side of said engine block and form a second bank of cylinders comprising a third grouping of four cylinders and a fourth grouping of four cylinders, wherein said first bank of cylinders is positioned directly across from said second bank of cylinders such that said first grouping of four cylinders is directly across from said third grouping of four cylinders and said second grouping of four cylinders is directly across from said fourth grouping of four cylinders, and wherein said first bank of cylinders is separated from said second bank of cylinders by a longitudinal centerline of said V-shaped engine block;

a first section formed in the engine block between middlemost cylinders of the first bank of cylinders;

a second section formed in the engine block between middlemost cylinders of the second bank of cylinders, wherein each of the first and second sections extend perpendicular to the longitudinal centerline, wherein each of the first and second sections are located substantially at the midpoint of the respective bank of cylinders, wherein each of the first and second sections define a first and second minimum width, respectively, between said middlemost cylinders of the respective bank of cylinders, and wherein the respective minimum width is greater than a respective minimum width defined between any two directly adjacent cylinders that are not the middlemost cylinders of the respective bank of cylinders;

a first passageway for circulating a coolant, the first passageway comprising:

a first supply channel located within the first section and defining a centralized point of entry for supplying the coolant to the first bank of cylinders from an area outside of the engine block;

a first return channel located within the first section and defining a centralized point of exit for returning the coolant from the first bank of cylinders to the area outside of the engine block;

a first pathway forming a first loop which extends from the first supply channel, about each cylinder in the first grouping of four cylinders, and to the first return channel; and a second pathway forming a second loop which extends from the first supply channel, about each cylinder in the second grouping of four cylinders, and to the first return channel, wherein said first pathway and said second pathway are located entirely within the first bank of cylinders; and a second passageway for circulating the coolant, the second passageway comprising:

a second supply channel located within the second section and defining a centralized point of entry for supplying the coolant to the second bank of cylinders from the area outside of the engine block;

a second return channel located within the second section and defining a centralized point of exit for returning the coolant from the second bank of cylinders to the area outside of the engine block;

a third pathway forming a third loop which extends from the second supply channel, about each cylinder in the third grouping of four cylinders, and to the second return channel; and a fourth pathway forming a fourth loop which extends from the second supply channel, about each cylinder in the fourth grouping of four cylinders, and to the second return channel, wherein said third pathway and said fourth pathway are located entirely within the second bank of cylinders.

2. The internal combustion engine of claim 1, further comprising a first cylinder head structure, a second cylinder head structure, a third cylinder head structure, and a fourth cylinder head structure, wherein the first cylinder head structure is affixed to the first grouping of four cylinders within the first bank of cylinders, the second cylinder head structure is affixed to the second grouping of four cylinders within the first bank of cylinders, the third cylinder head structure is affixed to the third grouping of four cylinders within the second bank of cylinders, and the fourth cylinder head structure is affixed to the fourth grouping of four cylinders within the second bank of cylinders.

3. The internal combustion engine of claim 2, wherein the first, second, third, and fourth cylinder head structures are substantially identical.

4. The internal combustion engine of claim 1, wherein the first supply channel and the first return channel extend parallel to one another, and wherein the second supply channel and the second return channel extend parallel to one another.

5. The internal combustion engine of claim 1 further comprising:

an oil storage tank comprising oil;

a first oil pump in fluid communication with the oil storage tank and configured to supply pressurized oil from the oil storage tank to an upper portion of the engine block located between the first bank of cylinders and the second bank of cylinders; and an oil supply passageway extending from said upper portion to said oil storage tank, wherein said oil supply passageway bypasses a crankshaft.

6. The internal combustion engine of claim 5 further comprising:

an oil return guide positioned in the upper portion, wherein said oil return guide comprises a planar surface positioned to direct upwardly splashing oil in the upper portion downward towards the oil supply passageway.

7. The internal combustion engine of claim 1, wherein the first pathway extends from the first supply channel in a first direction past a first side of each cylinder in the first grouping of four cylinders and returns in a second direction opposing the first direction along a second side of each cylinder in the first grouping of four cylinders to the first return channel, and wherein the second pathway extends from the first supply channel in the second direction past a first side of each cylinder in the second grouping of four cylinders and returns in the first direction along a second side of each cylinder in the second grouping of four cylinders to the first return channel.

8. The internal combustion engine of claim 7, wherein the third pathway extends from the second supply channel in the first direction past a first side of each cylinder in the third grouping of four cylinders and returns in the second direction along a second side of each cylinder in the third grouping of four cylinders to the second return channel, and wherein the fourth pathway extends from the second supply channel in the second direction past a first side of each cylinder in the fourth grouping of four cylinders and returns in the first direction along a second side of each cylinder in the fourth grouping of four cylinders to the second return channel.

9. The internal combustion engine of claim 8, wherein the first direction is opposite the second direction.

* * * * *